US009371738B2

(12) United States Patent
Harris

(10) Patent No.: US 9,371,738 B2
(45) Date of Patent: Jun. 21, 2016

(54) VARIABLE OUTER AIR SEAL SUPPORT

(71) Applicant: United Technologies Corporation, Hartford, CT (US)

(72) Inventor: Meggan Harris, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 849 days.

(21) Appl. No.: 13/721,435

(22) Filed: Dec. 20, 2012

(65) Prior Publication Data

US 2014/0212262 A1 Jul. 31, 2014

(51) Int. Cl.

| | |
|---|---|
| ***F01D 5/20*** | (2006.01) |
| ***F01D 11/22*** | (2006.01) |
| *F01D 25/24* | (2006.01) |

(52) U.S. Cl.

CPC ..... *F01D 11/22* (2013.01); *F01D 25/24* (2013.01); *F01D 25/246* (2013.01)

(58) Field of Classification Search

CPC . F05D 2230/64; F05D 2250/90; F01D 25/24; F01D 11/14; F16B 37/145

USPC ..... 415/173.1, 126; 411/338; 163/6

See application file for complete search history.

(56) References Cited

U.S. PATENT DOCUMENTS

| | | | | |
|---|---|---|---|---|
| 4,033,243 | A * | 7/1977 | Kirrish | F16B 37/145 411/338 |
| 5,056,988 | A | 10/1991 | Corsmeier et al. | |
| 5,609,469 | A | 3/1997 | Worley et al. | |
| 7,032,835 | B2 | 4/2006 | Murphy et al. | |
| 2005/0265827 | A1 | 12/2005 | Wilson, Jr. | |
| 2007/0020095 | A1 | 1/2007 | Dierksmeier et al. | |
| 2008/0159850 | A1 | 7/2008 | Tholen et al. | |
| 2012/0063884 | A1 | 3/2012 | Klingels | |

FOREIGN PATENT DOCUMENTS

| | | | | |
|---|---|---|---|---|
| GB | 2068470 A | * | 8/1981 | F01D 11/22 |
| JP | 2010037969 | | 2/2010 | |

OTHER PUBLICATIONS

International Preliminary Report on Patentability for International Application No. PCT/US2013/071429 mailed Jul. 2, 2015.

U.S. Appl. No. 13/495,454, filed Jun. 13, 2012.

International Search Report for PCT Application No. PCT/US2013/071429 mailed Sep. 1, 2014.

* cited by examiner

*Primary Examiner* — Dwayne J White
*Assistant Examiner* — Jason Mikus
(74) *Attorney, Agent, or Firm* — Carlson, Gaskey & Olds, P.C.

(57) ABSTRACT

A variable outer air seal support system according to an exemplary aspect of the present disclosure includes, among other things, a case having a plurality of slots, and an extension of a variable outer air seal segment. The extension provides at least one extension aperture. A connector pin is configured to move within the slot to move the variable outer air seal segment from a first position to a second position. The variable outer air seal segment overlaps a circumferentially adjacent variable outer air seal segment more in the first position than in the second position.

18 Claims, 8 Drawing Sheets

VARIABLE OUTER AIR SEAL SUPPORT

BACKGROUND

This disclosure relates to a support system for a blade outer air seal (BOAS), and more particularly to a support system for segments of a variable outer air seal.

Turbomachines, such as gas turbine engines, typically include a fan section, a compression section, a combustion section, and a turbine section. Turbomachines may employ a geared architecture connecting portions of the compression section to the fan section. BOAS assemblies circumscribe arrays of blades in the compression section, turbine section, or both. Turbomachines have developed passive and active systems for controlling clearances of the gap between the outer air seal and the tip of the turbine blade.

Supporting BOAS assemblies may be difficult. Fasteners can undesirably protrude into flowpaths of the turbomachine. Some components of the BOAS assemblies may not be able to accommodate direct clamping loads making fastener design in these areas difficult.

SUMMARY

A variable outer air seal support system according to an exemplary aspect of the present disclosure includes, among other things, a case having a plurality of slots, and an extension of a variable outer air seal segment. The extension provides at least one extension aperture. A connector pin is configured to move within the slot to move the variable outer air seal segment from a first position to a second position. The variable outer air seal segment overlaps a circumferentially adjacent variable outer air seal segment more in the first position than in the second position.

In a further non-limiting embodiment of the foregoing variable outer air seal support system, the case may include a groove that receives a head of the connector pin.

In a further non-limiting embodiment of either of the foregoing variable outer air seal support systems, the groove is an undulating groove.

In a further non-limiting embodiment of any of the foregoing variable outer air seal support systems, an open side of the groove may face axially.

In a further non-limiting embodiment of any of the foregoing variable outer air seal support systems, the slot may extend from a floor of the groove to an axially facing side of the case.

In a further non-limiting embodiment of any of the foregoing variable outer air seal support systems, a first end of the slot is located a first distance from a rotational axis of a turbomachine and an opposing second end of the slot is located a second distance from the rotational axis, the first distance may be different than the second distance.

In a further non-limiting embodiment of any of the foregoing variable outer air seal support systems, the connector pin includes a first portion and a second portion. The first portion has a bore that is threaded and extends from a leading surface along an axis. The second portion has an extension that is threaded. The bore is longer than the extension such that the leading surface may contact the second portion when the first portion is secured relative to the second portion.

In a further non-limiting embodiment of any of the foregoing variable outer air seal support systems, the system includes a link having a first end and a second end that is opposite the first end. The first end may provide at least one link aperture that receives the connector pin. The second end configured to engage another connector pin associated with a circumferentially adjacent variable outer air seal.

In a further non-limiting embodiment of any of the foregoing variable outer air seal support systems, the connector pin and the extension may pivot relative to each other when the variable outer air seal segment moves from the first position to the second position.

In a further non-limiting embodiment of any of the foregoing variable outer air seal support systems, the variable outer air seal segment may be a blade outer air seal segment.

A variable outer air seal connector pin according to an exemplary aspect of the present disclosure includes, among other things, a connector pin having a first portion and a second portion. The linkage configured to couple a segment of a blade outer air seal to a link. The first portion has a bore that is threaded and extends from a leading surface along an axis. The second portion has an extension that is threaded. The bore is longer than the extension such that the leading surface contacts the second portion when the first portion is secured relative to the second portion.

In a further non-limiting embodiment of the foregoing variable outer air seal connector pin, the connector pin is configured to rotate relative to the link and the segment.

In a further non-limiting embodiment of either of the foregoing variable outer air seal connector pins, the connector is configured to be received within an aperture provided by an extension of the blade outer air seal.

In a further non-limiting embodiment of any of the foregoing variable outer air seal connector pins, an end of the first portion opposite the leading surface may have a head having a larger cross-sectional diameter than a cross-sectional diameter of the leading surface.

In a further non-limiting embodiment of any of the foregoing variable outer air seal connector pins, the cross-sectional diameter of the flanged head is larger than a cross-sectional diameter of the aperture provided by the extension.

In a further non-limiting embodiment of any of the foregoing variable outer air seal connector pins, the first and the second portion both have heads having larger cross-sectional diameters than other areas of the first and second portions.

A method of actuating a variable outer air seal system according to another exemplary aspect of the present disclosure includes, among other things, moving a connector pin within a slot to move a variable outer seal segment from a first position to a second position. The variable outer air seal segment overlaps a circumferentially adjacent variable outer air seal segment more the first position than in the second position.

In a further non-limiting embodiment of the foregoing method of actuating a variable outer air seal system, the method includes coupling a link to the variable outer air seal using the connector pin, and moving the link to move the variable outer air seal.

In a further non-limiting embodiment of the foregoing method of actuating a variable outer air seal system, the method includes moving a circumferentially adjacent variable outer air seal segment to move the link.

In a further non-limiting embodiment of either of the foregoing methods of actuating a variable outer air seal system, the method slides a head of the connector within a grove when moving the connector pin.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
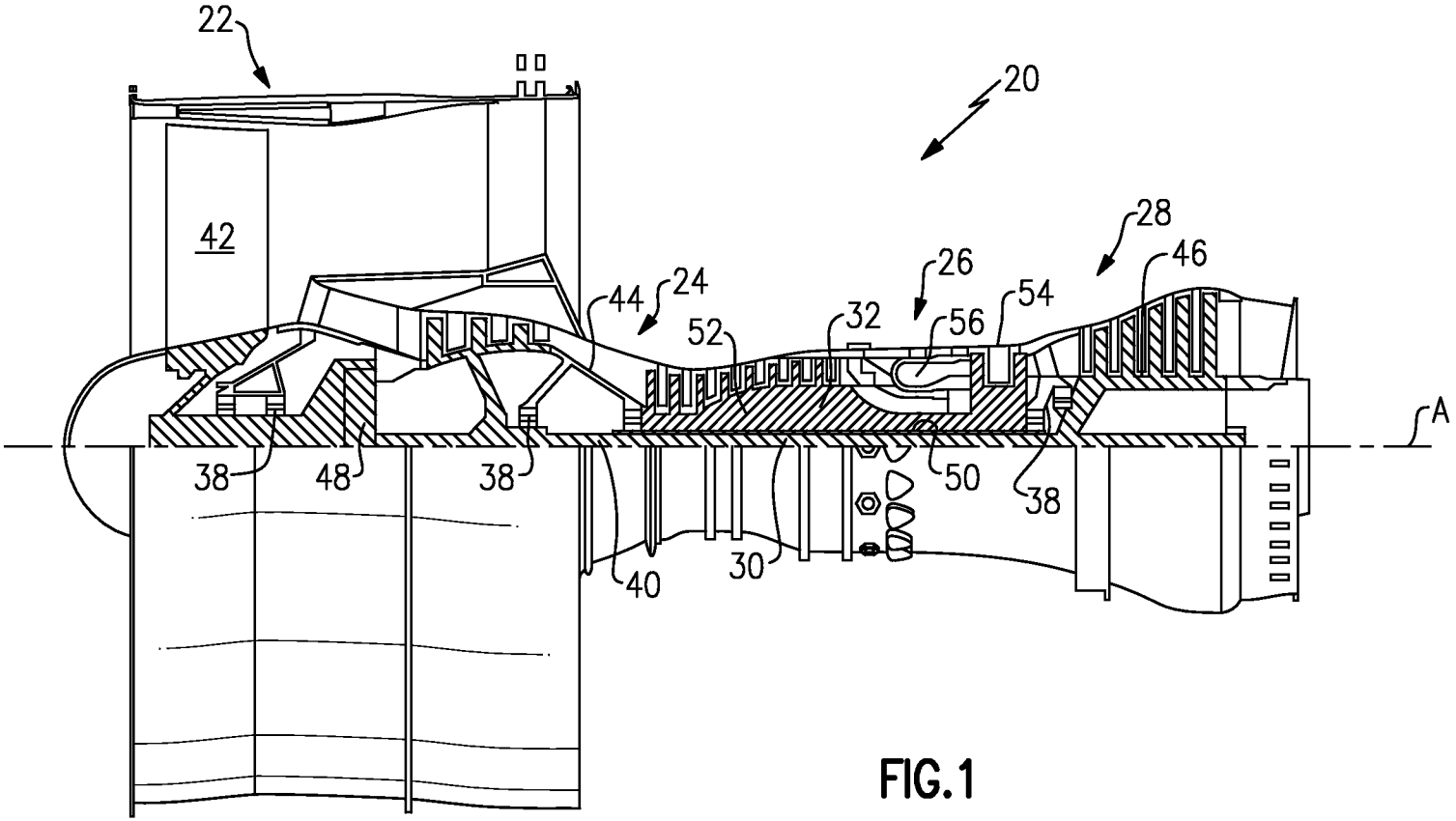
FIG. 1 is a cross-sectional view of an example turbomachine.

FIG. 1 schematically illustrates an example turbomachine, which is a gas turbine engine 20 in this example. The gas turbine engine 20 is a two-spool turbofan gas turbine engine that generally includes a fan section 22, a compression section 24, a combustion section 26, and a turbine section 28.

Although depicted as a two-spool turbofan gas turbine engine in the disclosed non-limiting embodiment, it should be understood that the concepts described herein are not limited to use with turbofans. That is, the teachings may be applied to other types of turbomachines and turbine engines including three-spool architectures. Further, the concepts described herein could be used in environments other than a turbomachine environment and in applications other than aerospace applications.

In the example engine 20, flow moves from the fan section 22 to a bypass flowpath. Flow from the bypass flowpath generates forward thrust. The compression section 24 drives air along a core flowpath. Compressed air from the compression section 24 communicates through the combustion section 26. The products of combustion expand through the turbine section 28.

The example engine 20 generally includes a low-speed spool 30 and a high-speed spool 32 mounted for rotation about an engine central axis A. The low-speed spool 30 and the high-speed spool 32 are rotatably supported by several bearing systems 38. It should be understood that various bearing systems 38 at various locations may alternatively, or additionally, be provided.

The low-speed spool 30 generally includes a shaft 40 that interconnects a fan 42, a low-pressure compressor 44, and a low-pressure turbine 46. The shaft 40 is connected to the fan 42 through a geared architecture 48 to drive the fan 42 at a lower speed than the low-speed spool 30.

The high-speed spool 32 includes a shaft 50 that interconnects a high-pressure compressor 52 and high-pressure turbine 54.

The shaft 40 and the shaft 50 are concentric and rotate via bearing systems 38 about the engine central longitudinal axis A, which is collinear with the longitudinal axes of the shaft 40 and the shaft 50.

The combustion section 26 includes a circumferentially distributed array of fuel nozzles within an annular combustor 56 that is generally arranged axially between the high-pressure compressor 52 and the high-pressure turbine 54.

In some non-limiting examples, the engine 20 is a high-bypass geared aircraft engine. In a further example, the engine 20 bypass ratio is greater than about six (6 to 1).

The geared architecture 48 of the example engine 20 includes an epicyclic gear train, such as a planetary gear system or other gear system. The example epicyclic gear train has a gear reduction ratio of greater than about 2.3 (2.3 to 1).

The low-pressure turbine 46 pressure ratio is pressure measured prior to inlet of low-pressure turbine 46 as related to the pressure at the outlet of the low-pressure turbine 46 prior to an exhaust nozzle of the engine 20. In one non-limiting embodiment, the bypass ratio of the engine 20 is greater than about ten (10 to 1), the fan diameter is significantly larger than that of the low-pressure compressor 44, and the low-pressure turbine 46 has a pressure ratio that is greater than about five (5 to 1). The geared architecture 48 of this embodiment is an epicyclic gear train with a gear reduction ratio of greater than about 2.5 (2.5 to 1). It should be understood, however, that the above parameters are only exemplary of one embodiment of a geared architecture engine and that the present disclosure is applicable to other gas turbine engines including direct drive turbofans.

In this embodiment of the example engine 20, a significant amount of thrust is provided by the bypass flow due to the high bypass ratio. The fan section 22 of the engine 20 is designed for a particular flight condition—typically cruise at about 0.8 Mach and about 35,000 feet. This flight condition, with the engine 20 at its best fuel consumption, is also known as "Bucket Cruise" Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example engine 20 is less than 1.45 (1.45 to 1).

"Low Corrected Fan Tip Speed" is the actual fan tip speed in ft/sec divided by an industry standard temperature correction of [(Tram ° R)/(518.7° R)]^0.5. The Temperature represents the ambient temperature in degrees Rankine. The Low Corrected Fan Tip Speed according to one non-limiting embodiment of the example engine 20 is less than about 1150 fps (351 m/s).

Figure 2:
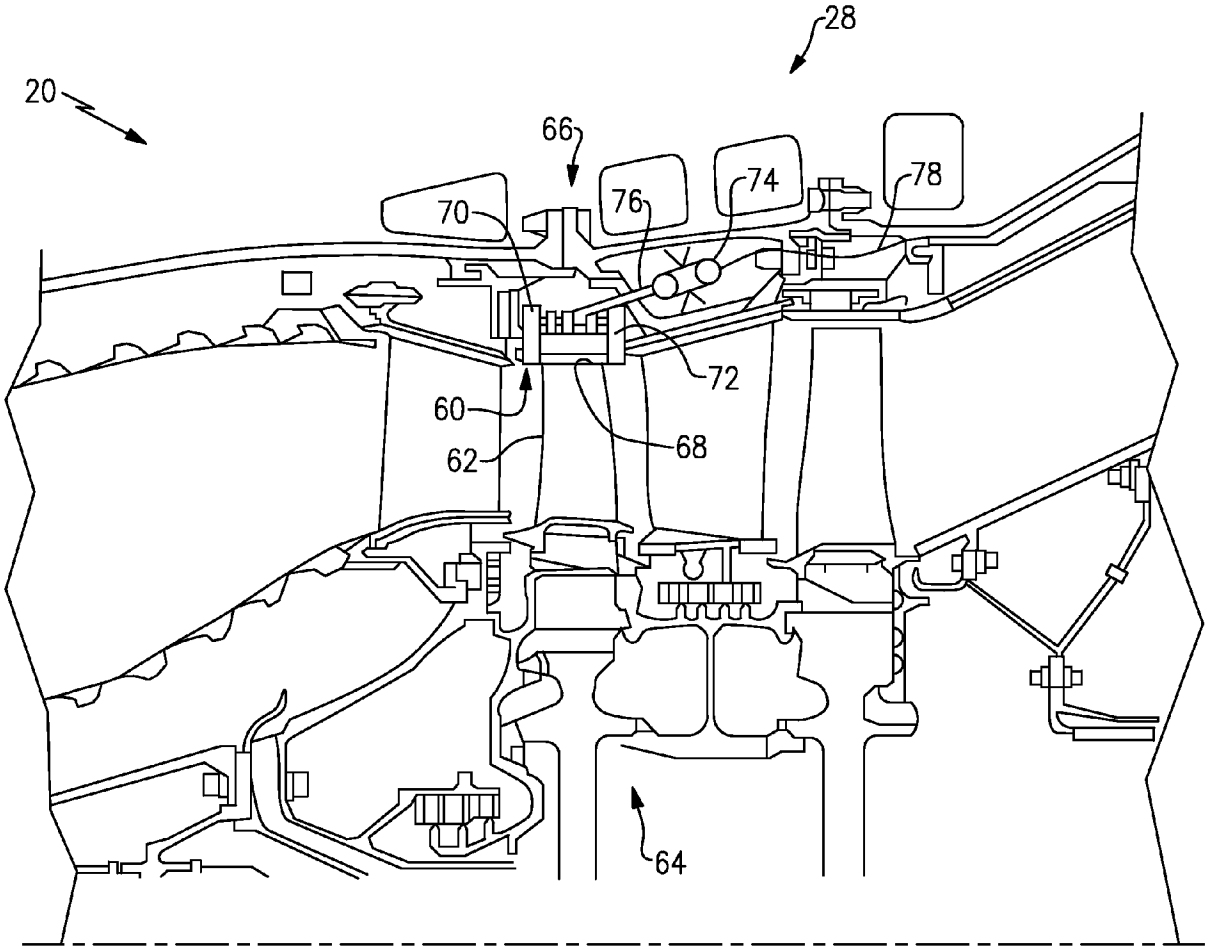
FIG. 2 shows a cross-sectional view of the high-pressure turbine of the turbomachine of FIG. 1.
Figure 3:
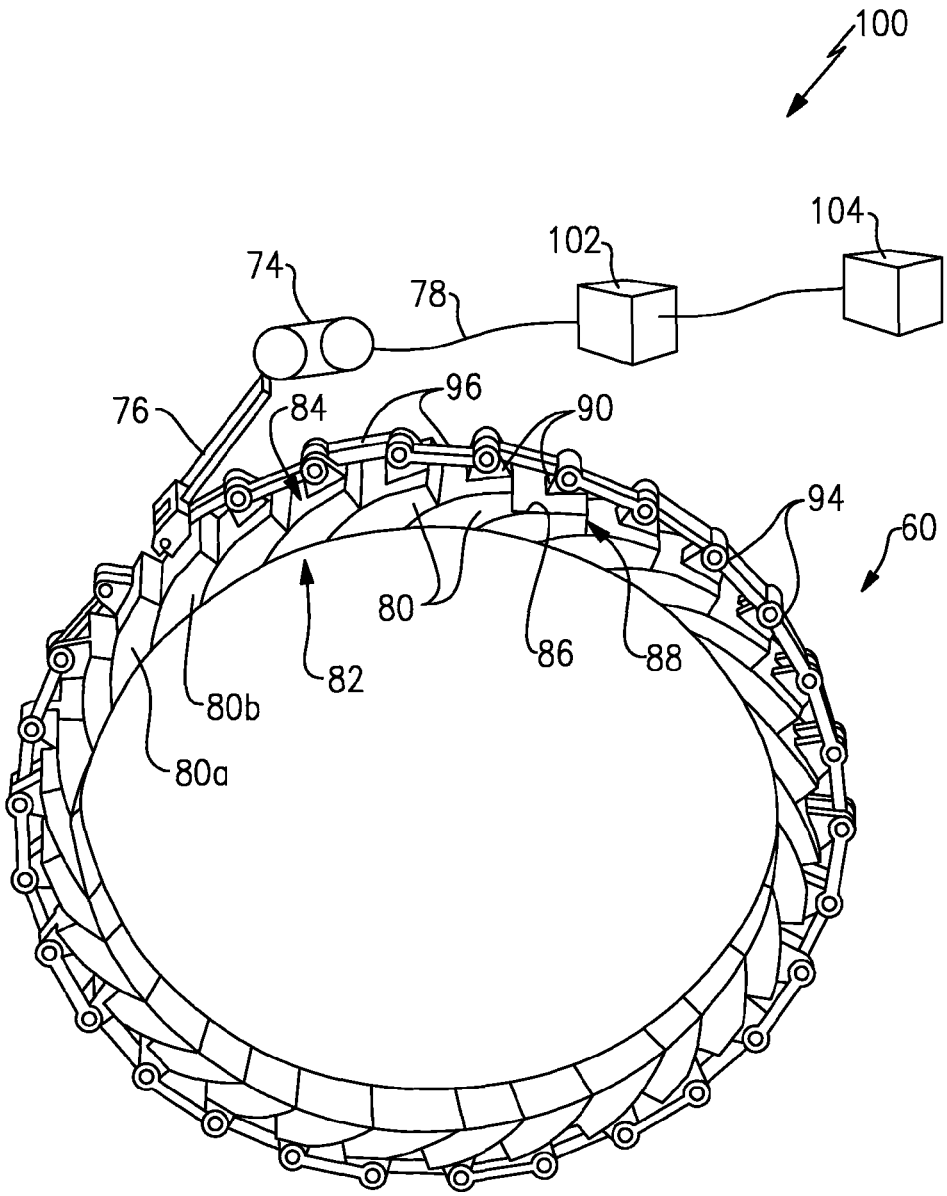
FIG. 3 shows a perspective view of a variable area outer air seal control system.
Figure 4:
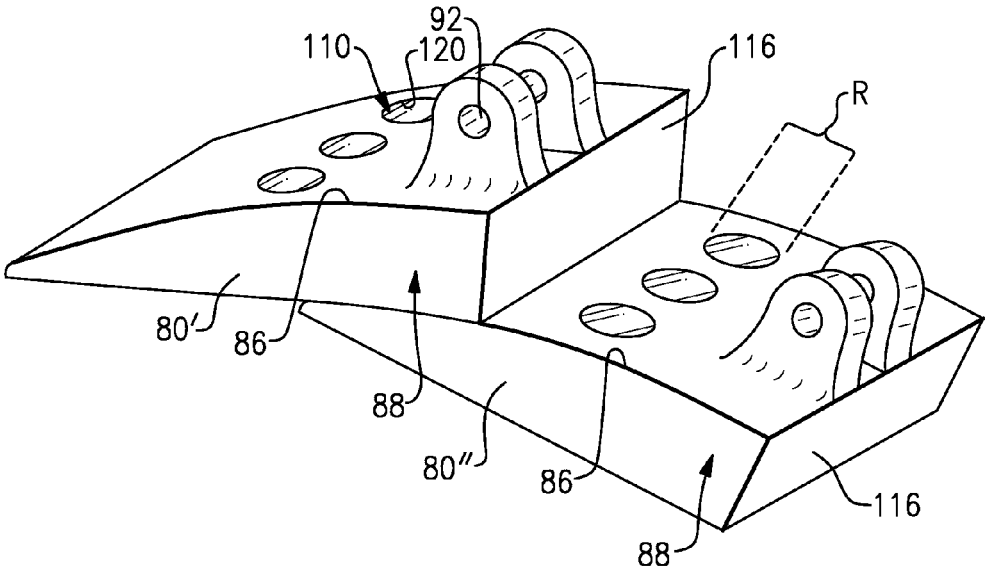
FIG. 4 shows a close up view of two variable area outer air seals of the system of FIG. 3 in a first position.

Referring to FIGS. 2 to 4, the turbine section 28 of the engine 20 includes a blade outer air seal ("BOAS") assembly 60 disposed between a plurality of circumferentially distributed rotor blades 62 of a rotor stage 64, and an annular outer engine case 66. In one embodiment, the BOAS 60 is adapted to limit air leakage between blade tips 68 and the engine case 66. The example BOAS 60 is supported by rails 70 and 72 attached to the engine case 66. BOAS 60 is also connected to an actuator 74 through a rod 76. The actuator 74 may connect to a main digital control. In some examples, the actuator 74 may be wired to a control system via a cable 78.

The BOAS 60 includes multiple variable outer air seal segments 80 distributed annularly about the axis A. In this example, each segment has radially inwardly facing surfaces 82 and radially outwardly facing surfaces 84. The segments 80 each include an inclined surface 86 attached to a base portion 88. The inclined surface 86 is one of the radially outwardly facing surfaces 84 in this example. An extension 90 extends radially outward from the base portion 88. The extension 90 may be a stanchion, tab, lug, or some other structure. The extension 90 has an aperture 92 for receiving a connector pin 94.

Each segment 80 is connected to a circumferentially adjacent segment through a link 96 attached with the connector pin 94. Some of the segments, 80*a* and 80*b* are attached to a single circumferentially adjacent segment 80. Segment 80*b* is attached to the actuating rod 76. Actuating rod 76 is directly coupled to the actuator 74. Actuator 74 is attached to a control system 100 via the cable 78. In other examples, the actuator 74 attaches the main digital electronic control of the engine 20 in another ways.

The control system 100, in this example, includes a sensor 102, for example a thermocouple, which may be positioned to sense a gas path temperature at a particular location along a core flow path of the engine. In one example, the sensor 102 extends through a turbine case to measure a temperature approximate location T4 at the entrance to the high-pressure turbine section 54, where airfoils and other components are particularly susceptible to thermal damage due to peaking gas temperatures. In another example, temperature sensor 102 may be positioned approximate another stage of the high-pressure turbine 54, or within the low-pressure turbine 46, or a compression section 24. In other examples, a number of temperature probes are positioned in different locations within the engine 20 to measure multiple gas path temperatures along flowpaths of the engine 20.

The control system 100 includes a flight controller 104 having a flight condition module, a thrust control, and other related engine functions. Depending on the embodiment, the flight controller 104 may comprise additional flight, engine, and navigational systems utilizing other control, sensor, and processor components located throughout the engine 20, and in other regions of the engine.

Flight controller 104 includes a combination of software and hardware components configured to determine and report flight conditions relevant to the operation of engine 20. In general, flight controller 104 includes a number of individual flight modules, which determine a range of different flight conditions based on a combination of pressure, temperature and spool speed measurements and additional data such as attitude and control surface positions.

Flight controller 104 may include a control law (CLW) configured to direct actuator 74 to adjust the modulated BOAS 60. The CLW directs actuator 74 based on the sensed inputs from sensor 102, the flight conditions determined by flight module, and other parameters, such as core flow gas path temperatures TC.

The flight controller 104 may direct the actuator 74 to adjust rod 76 in order to regulate the gap between the blade tips and radially inward facing surfaces 82 of the segments 80. The linkage design connected to modulated BOAS 60 is designed such that if pushed in one direction, linkages are pulled in tension, thus increasing the diameter of the modulated BOAS 60, while movement in the other direction creates compression within the linkages and decreases the overall diameter of modulated BOAS 60. The movement may be likened to that of a camera aperture.

Figure 5:
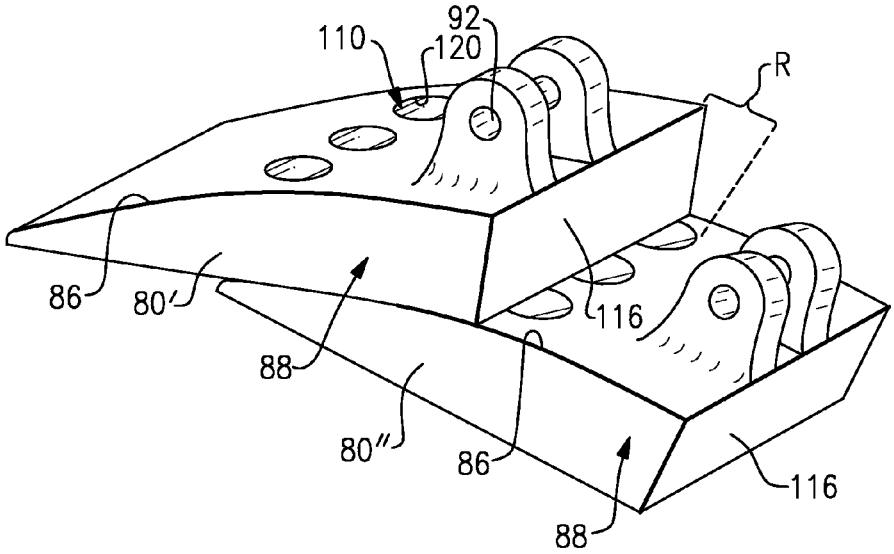
FIG. 5 shows the two variable area outer air seals of FIG. 4 in second position where the seals are more overlapped than when in the first position.
Figure 6:
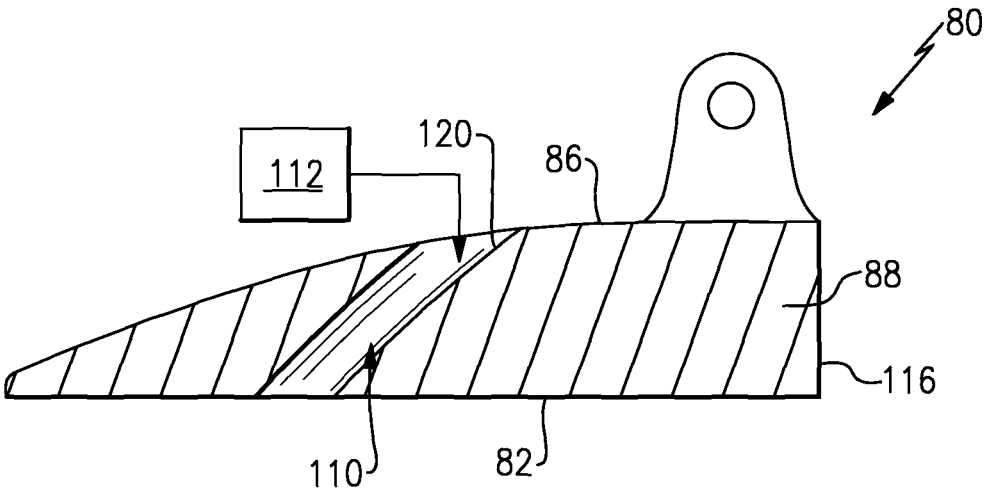
FIG. 6 shows a section view of one of the variable area outer air seals of FIG. 4.

Referring to FIGS. 5 and 6 with continuing reference to FIGS. 2 to 4, adjacent ones of the segments 80 are moveable to shiplapped positions. When shiplapped, portions of circumferentially adjacent segments 80 overlap each other. The flight controller 104 may direct the actuator 74 to adjust rod 76 to move circumferentially adjacent segments 80' and 80" (FIGS. 4 and 5) between the less shiplapped position of FIG. 4 and the more shiplapped position of FIG. 5. In some examples, the actuator 74 may be configured to move the circumferentially adjacent segments 80' and 80" to positions where no portion of circumferentially adjacent segments 80' and 80" overlap.

The example segments 80' and 80" include channels 110 extending from the inclined surface 86 to a radially inward facing surface 82. The channels 110 deliver a fluid, such as cooling air from a supply 112 to an interface between the radially inward facing surface 82 and the blade tip 68. The supply 112 is radially outside the segments 80' and 80" in this example.

The flight controller 104 may direct the actuator 74 to adjust rod 76 in order to regulate flow of fluid through the channels 110. The fluid cools the interface. The flow is regulated by selectively blocking flow entering an inlet 120 of the channels 110. For example, the segment 80' is used to selectively block the flow through channels 110 in the segment 80".

The segment 80' blocks flow through the channels 110 in the segment 80" by covering some or all of the inlets 120 in the segment 80". In this example, in circumferential Region R, increasing the circumferential overlap between the segments 80' and 80" increases the amount of blocked flow and reduces the amount of flow moving through channels 110. The amount of blocked flow may thus be controlled by varying the amount of overlap between the segment 80 and the inlets 120.

The example channels 110 are shown as being entirely within a single one of the segments 80' or 80". In other examples, the channels 110 may be defined partially by one of the segments 80' or 80", such as if the channels 110 were notches in a side of one of the segments 80' and 80".

Figure 7:
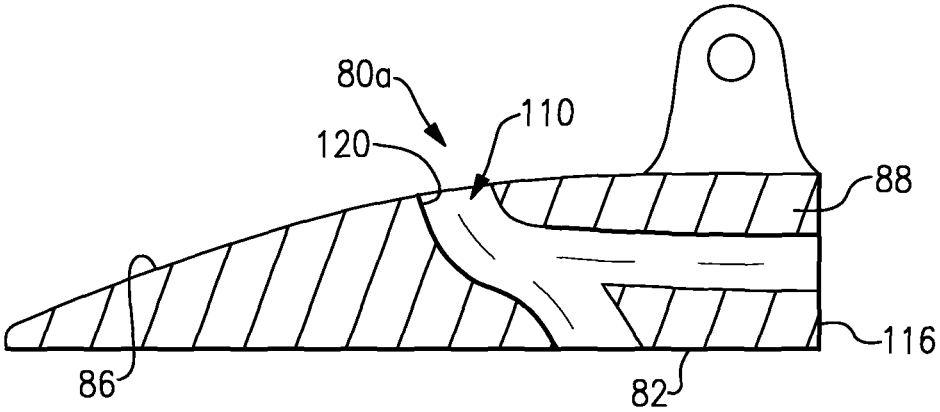
FIG. 7 shows a section view another example variable area outer air seal.
Figure 8:
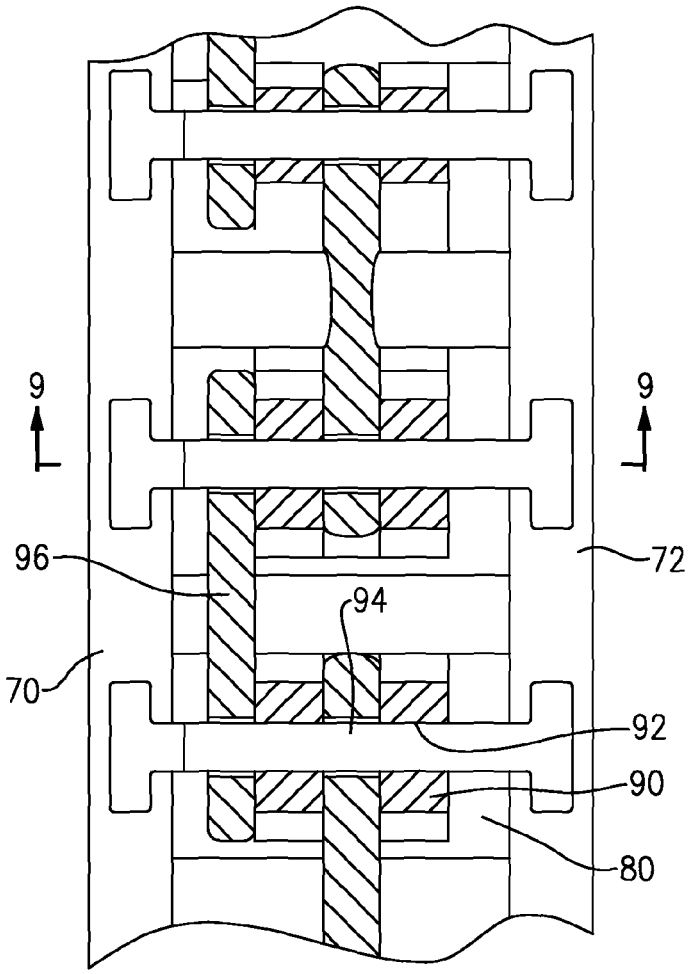
FIG. 8 shows a radially outward facing portion of the variable area outer air seal control system of FIG. 3.
Figure 11:
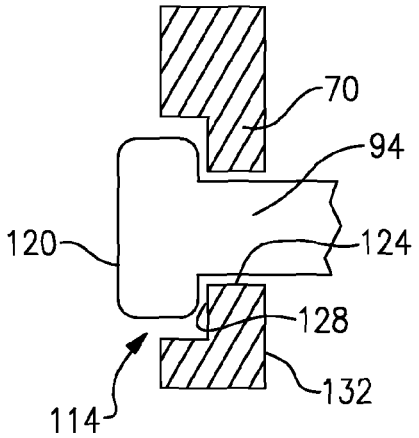
FIG. 11 shows a section view at line 11-11 in FIG. 10.
Figure 9:
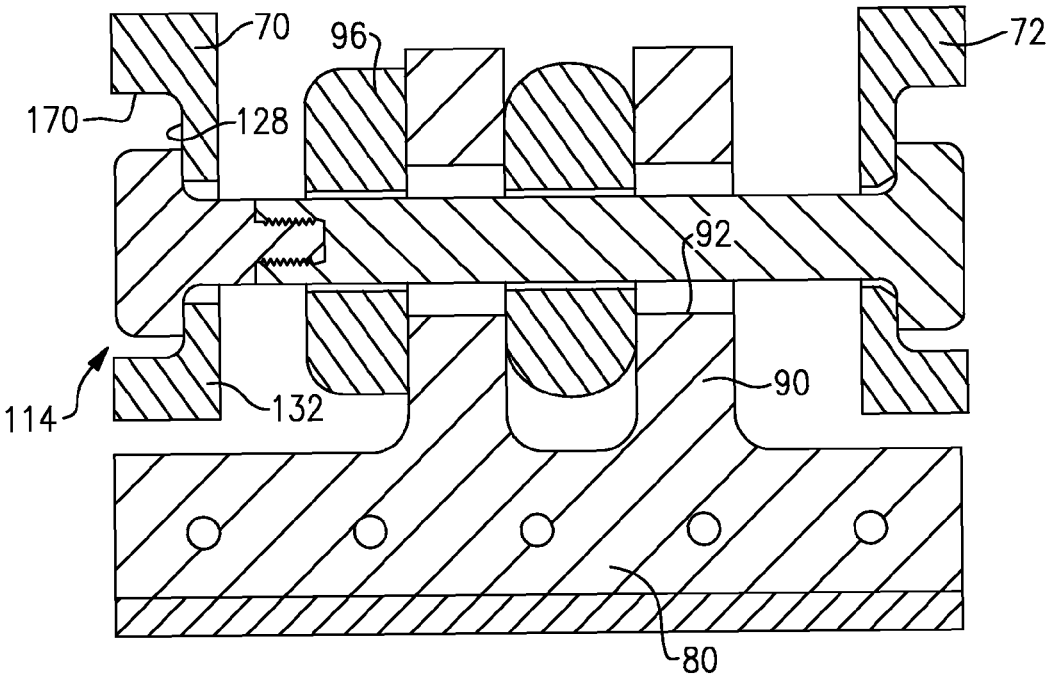
FIG. 9 shows a section view at line 9-9 in FIG. 8.
Figure 10:
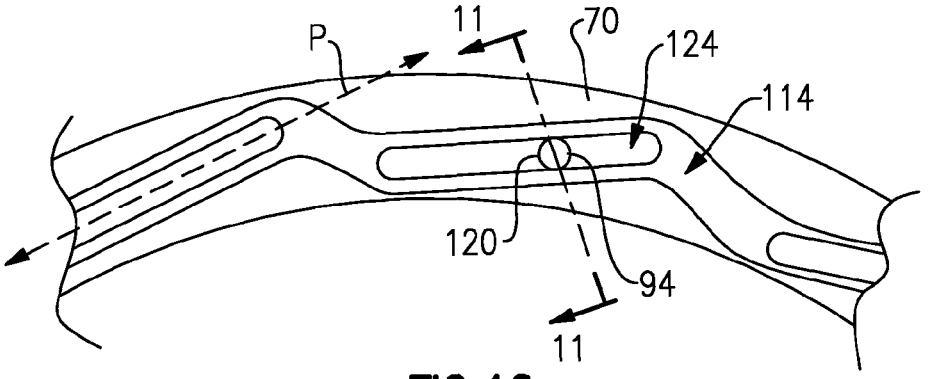
FIG. 10 shows a side view of FIG. 8.
Figure 12:
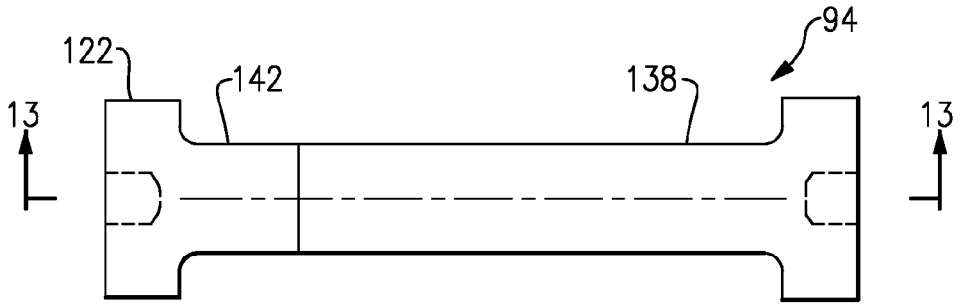
FIG. 12 shows a perspective view of a connector pin of the system of FIG. 3.
Figure 13:
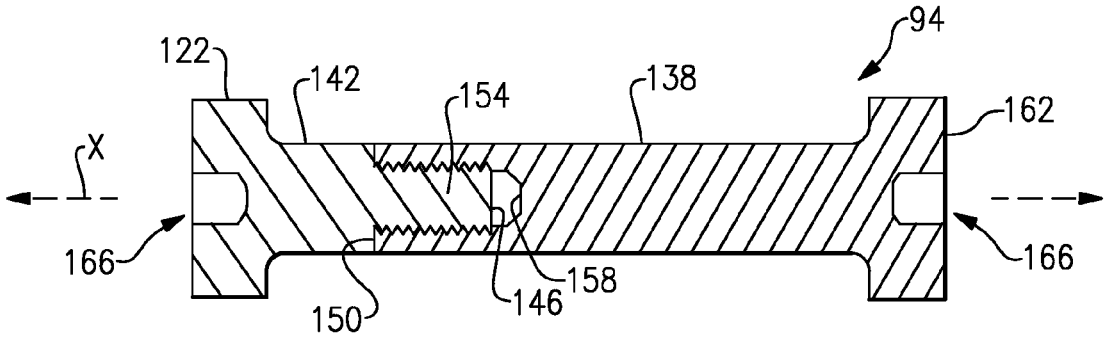
FIG. 13 shows a section view at line 13-13 in FIG. 12.

The example channels 110 deliver fluid to the radially inward facing surfaces 82 interacting with the blade tip 68. In other examples, the channels 110 may instead, or in addition to, deliver fluid to other areas, such as to a circumferentially facing surface 116 of the segments 80 (FIG. 7). The size, angles, and positions of the channels 110 is adjustable according to specific cycle requirements, method or control, etc.

Referring now to FIGS. 8 to 13, a support system for the BOAS 60 includes at least the cases 70 and 72, the extensions 90 of the segments 80, and the connector pin 94. The case 70 includes a groove 114 that receives a head 122 of the connector pin 94. The connector pin 94 extends through a slot 124 extending axially from a floor 128 of the groove 114. The slot 124 extends from the floor 128 to an opposing axially facing side 132 of the case 70.

The example connector pin 94 includes a first portion 138 and a second portion 142. The first portion 138 includes a threaded bore 146 extending axially from a leading edge 150 of the first portion 138. The second portion 142 includes a threaded extension 154. The bore 146 is configured to threadably receive the extension 154. The bore 146 is deeper than the extension 154 so that the leading edge 150 of the first portion 138 contacts the second portion 142 before the extension 154 bottoms out on a bottom 158 of the bore 146. This arrangement controls the axial length X of the connector pin 94.

The first portion includes a head 162. The head 162 of the first portion 138 and the head 122 of the second portion 142 each include a wrenching feature 166 (such as a torx recess) that can be utilized by a tool to rotate the first portion 138 relative to the second portion 142 to threadably engage the bore 146 with the extension 154. Threads on the extension 154, the bolt 146, or both may be intentionally deformed to provide a self-locking feature with the connector pin 94.

The connector pin 94 couples the segments 80 together. When coupled, the connector pin 94 is received within the apertures 92 of the extensions 90, as well as within apertures of the link 96. The apertures 92 may be oversized to allow for pressure float. Moving the link 96 circumferentially exerts force on the connector pin 94, which is then transferred through the extensions 90 into the segment 80 to move the segment 80 along a path P. The links 96 may be considered alternating links as they are arranged on alternating sides of the extensions 90.

In this example, each segment 80 has an associated path P. The paths P are angled such that first ends of the paths P are radially further from the rotational axis A than opposing second ends of the paths P. Moving the segments 80 along the paths P moves the segments between less overlapping and more overlapping positions.

The path P of movement is constrained due to the head 122 of the connector pin 94 being received within the groove 114. Walls 170 of the groove 114 may limit movement of the connector pin 94 away from a path P. The slots 124 also constrain movement of the connector pin 94 to confine its movement to the path P. The rail 72 may include a similar slot and groove for engaging the first portion 138 and the head 162 of the first portion 138. The floor 128 of the groove 114 may be coated with a fabroid liner to encourage movement within the groove 114.

When the connector pin 94 moves along the path P, the connector pin 94 may rotate relative to the extensions 90 and the connector link 96. The heads 120 and 162 have a larger cross-sectional diameter than the remaining portions of the connector pin 94, which prevents the connector pin 94 from moving axially relative to the rail 70 and 72.

The example groove 114 is an undulating groove machined into an axially facing surface of the rail 70. The open side of the groove 114 faces upstream relative to a direction of flow through the engine 20 (FIG. 1). The path P has opposing ends.

Although the example connector pin 94 is described as being used within a support system, the connector pin 94 could be used in other areas of the engine 20.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A variable outer air seal support system, comprising:

a case having plurality of slots;

an extension of a variable outer air seal segment, the extension providing at least one extension aperture;

a connector pin extending through both one of the plurality of slots and the at least one extension aperture, the connector pin configured to move within the slot to move the variable outer air seal segment from a first position to a second position, the variable outer air seal segment overlapping a circumferentially adjacent variable outer air seal segment more in the first position than in the second position; and a link having a first end and a second end that is opposite the first end, the first end providing at least one link aperture that receives the connector pin, the second end configured to engage another connector pin associated with a circumferentially adjacent variable outer air seal.

2. The variable outer air seal support system of claim 1, wherein the case includes a groove that receives a head of the connector pin.

3. The variable outer air seal support system of claim 2, wherein the groove is an undulating groove.

4. The variable outer air seal support system of claim 2, wherein an open side of the groove faces axially.

5. The variable outer air seal support system of claim 2, wherein the slot extends from a floor of the groove to an axially facing side of the case.

6. The variable outer air seal support system of claim 1, wherein a first end of the slot is located a first distance from a rotational axis of a turbomachine and an opposing second end of the slot is located a second distance from the rotational axis, the first distance different than the second distance.

7. The variable outer air seal support system of claim 1, including a first portion and a second portion of the connector pin, the first portion having a bore that is threaded and extends from a leading surface along an axis, the second portion having an extension that is threaded, wherein the bore is longer than the extension such that the leading surface contacts the second portion when the first portion is secured relative to the second portion.

8. The variable outer air seal support system of claim 1, wherein the connector pin and the extension pivot relative to each other when the variable outer air seal segment moves from the first position to the second position.

9. The variable outer air seal support system of claim 1, wherein the variable outer air seal segment is a blade outer air seal segment.

10. A variable outer air seal connector pin, comprising:

a connector pin having a first portion and a second portion, the linkage configured to couple a segment of a blade outer air seal to a link, a first portion having a bore that is threaded and extends from a leading surface along an axis; and a second portion having an extension that is threaded, wherein the bore is longer than the extension such that the leading surface contacts the second portion when the first portion is secured relative to the second portion, wherein the connector pin includes a head configured to be received within a groove of a case.

11. The variable outer air seal connector pin of claim 10, wherein the connector pin extends along a pin axis, and the connector pin is configured to rotate relative to the link and the segment.

12. The variable outer air seal connector pin of claim 10, wherein the connector pin is configured to be received within an aperture provided by an extension of the blade outer air seal.

13. The variable outer air seal connector pin of claim 10, wherein an end of the first portion opposite the leading surface has a head having a larger cross-sectional diameter than a cross-sectional diameter of the leading surface.

14. The variable outer air seal connector pin of claim 13, wherein the cross-sectional diameter of the flanged head is larger than a cross-sectional diameter of the aperture provided by the extension.

15. The variable outer air seal connector pin of claim 10, wherein the first and the second portion both have heads having larger cross-sectional diameters than other areas of the first and the second portions.

16. A method of actuating a variable outer air seal system, comprising:

moving a connector pin within a slot to move a variable outer air seal segment from a first position to a second position, the variable outer air seal segment overlapping a circumferentially adjacent variable outer air seal segment more in the first position than in the second position; and sliding a head of the connector pin within a groove when moving the connector pin.

17. The method of claim 16, including coupling a link to the variable outer air seal using the connector pin, and moving the link to move the variable outer air seal.

18. The method of claim 17, including moving a circumferentially adjacent variable outer air seal segment to move the link.

* * * * *